US008052821B2

(12) United States Patent
Cheng

(10) Patent No.: US 8,052,821 B2
(45) Date of Patent: Nov. 8, 2011

(54) METHOD FOR MANUFACTURING A FACEMASK STRUCTURE

(76) Inventor: Yung-Chu Cheng, Taipei (TW)

( * ) Notice: Subject to any disclaimer, the term of this patent is extended or adjusted under 35 U.S.C. 154(b) by 388 days.

(21) Appl. No.: 12/453,493

(22) Filed: May 13, 2009

(65) Prior Publication Data

US 2009/0217502 A1 Sep. 3, 2009

Related U.S. Application Data

(63) Continuation-in-part of application No. 10/944,731, filed on Sep. 21, 2004, now abandoned.

(51) Int. Cl.
*B32B 37/00* (2006.01)

(52) U.S. Cl. ..... 156/227; 156/228

(58) Field of Classification Search ..... 156/196, 156/223, 224, 227, 228, 580, 581
See application file for complete search history.

(56) References Cited

U.S. PATENT DOCUMENTS

| | | | | |
|---|---|---|---|---|
| 3,664,335 | A * | 5/1972 | Boucher et al. | 128/206.19 |
| 4,300,549 | A * | 11/1981 | Parker | 128/206.19 |
| 5,803,077 | A * | 9/1998 | Gazzara | 128/205.27 |
| 6,394,090 | B1 * | 5/2002 | Chen et al. | 128/206.12 |
| 6,474,336 | B1 * | 11/2002 | Wolfe | 128/206.21 |

* cited by examiner

*Primary Examiner* — James Sells
(74) *Attorney, Agent, or Firm* — Rosenberg, Klein & Lee

(57) ABSTRACT

A method for manufacturing facemask structure includes following steps. A facemask with first folds is placed on a seat and a pressing body forces the facemask so as to form step-shaped structures. Then, two movable plates are used to form the step-shaped structures as second folds on the facemask. Thereby, the mask can be stretched both vertically and horizontally, in a way that the mask body becomes more three-dimensional, fitting more firmly to the contours of a wearer's face, and providing more comfort and convenience than the conventional facemasks.

4 Claims, 5 Drawing Sheets

METHOD FOR MANUFACTURING A FACEMASK STRUCTURE

CROSS-REFERENCE TO RELATED APPLICATIONS

This Application is a Continuation-in-Part of application Ser. No. 10/944,731, filed on 21 Sep. 2004 now abandoned, and entitled FACEMASK STRUCTURE IMPROVEMENT.

BACKGROUND OF THE INVENTION

1. Field of the Invention

The present invention relates to a method for manufacturing facemasks, but more precisely, it is a method for manufacturing facemask structures that renders them more three-dimensional as to fit better to the face of the wearer.

2. Description of Related Art

The major function of a facemask lies in creating a special breathing cavity, which harmful substances in the air are kept from entering that cavity, and harmful substances exhaled by the wearer are prevented from exiting that cavity. This keeps the hazardous substances in the air from being inhaled, and the exhaled hazardous substances from affecting the environment.

Different facemasks are used for different needs. Generally, the common facemasks are disposable and are usually referred to as simple facemasks. A simple facemask is one in which the filtering materials themselves are made into the face configuration, in a way that the filtering face configuration comes in direct contact with the face of the wearer. The simple facemask is well known and popular since it is cheap, easy to use, and widely available.

Referring to FIG. 1, a disposable facemask as disclosed includes a mask body 80 and two ear bands 90. The mask body 80 is made of a filtering material and is rectangular in shape, covering over the nose and mouth of the wearer. The two ear bands 90 are respectively connected to the two sides of the mask body 80 and loops around the ears of the wearer, so that the mask body 80 can be held in place to cover over the nose and mouth of the wearer.

The disposable facemask is generally made planar shaped, with ear bands 90 thereof used to loop around the ears of the wearer. Since people's faces are not planar, facemasks such as these have serious leakage problems. To resolve this problem, a plurality of folds 81 are placed on the mask body 80 of a disposable facemask extending horizontally, forming a cambered shape to cover over part of the face of the wearer.

However, the afore said conventional facemask structure has a rather cramped shape because the mask body 80 merely provides a plurality of horizontal extending folds 81 and thus the mask body 80 can only be stretched vertically. Hence, the conventional facemask cannot conform closely to the contours of the face of the wearer, allowing gaps to form causing leakages. Moreover, the conventional facemask provides a very limited cavity for the wearer to breath and converse, and comes in direct contact with mouth of the wearer when he or she tries to speak. On the other hand, there is a traditional facemask only with vertical folds. However, in the facemask industry, there is no facemask with multi-direction folds (i.e., the vertical and the horizontal folds) in the market.

Therefore, due to these inconvenience and disadvantages, the conventional facemask was meant to be improved.

SUMMARY OF THE INVENTION

The objective of the present invention is to provide a facemask which can be stretched both vertically and horizontally, thus being better three-dimensionally shaped than conventional facemask, and conforming better to the contour of the wearer's face, effectively avoiding leaks while giving the wearer the convenience of a better breathing cavity which would also make conversing easy.

To meet the objective described above, this invention provides a method by which the new facemask structure includes a mask body having two pluralities of folds as well as ear bands that respectively connects to the two sides of the mask body. The two pluralities of folds consist of a first plurality of folds extending horizontally on the mask body, and a plurality of second folds extending vertically.

BRIEF DESCRIPTION OF THE DRAWINGS

The foregoing aspects and many of the attendant advantages of this invention will become more readily appreciated as they become better understood by reference to the following detailed description, when taken in conjunction with the accompanying drawings, wherein.

DETAILED DESCRIPTION OF THE PREFERRED EMBODIMENTS

Figure 1:
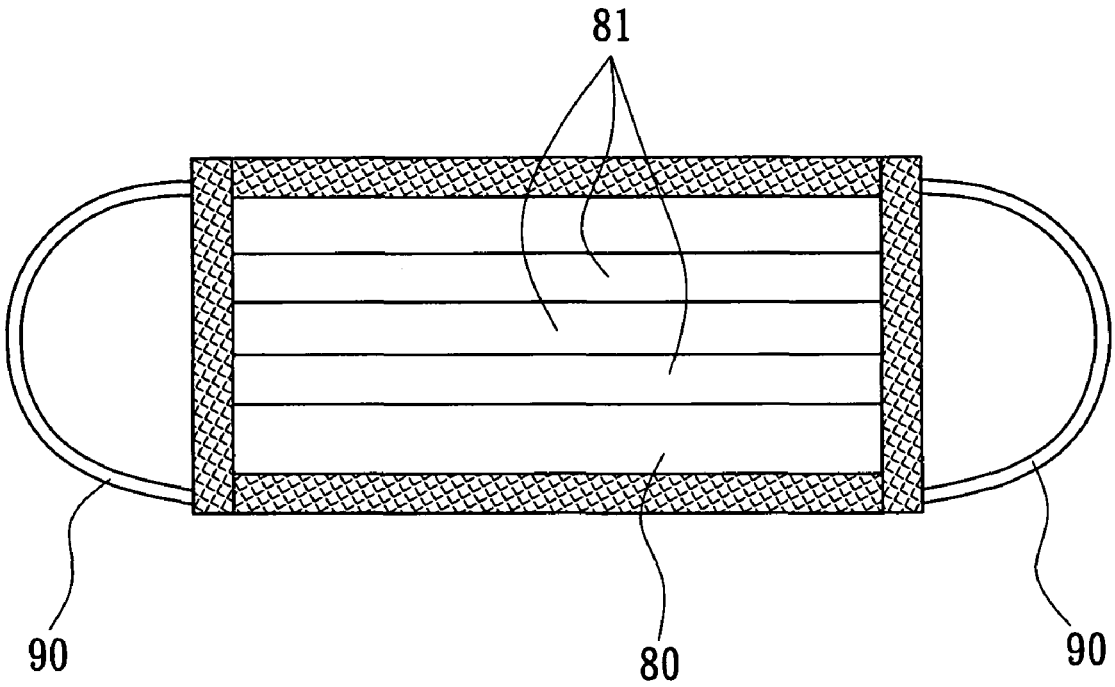
FIG. 1 PRIOR ART
FIG. 1 is a plan view showing a conventional facemask.
Figure 2:
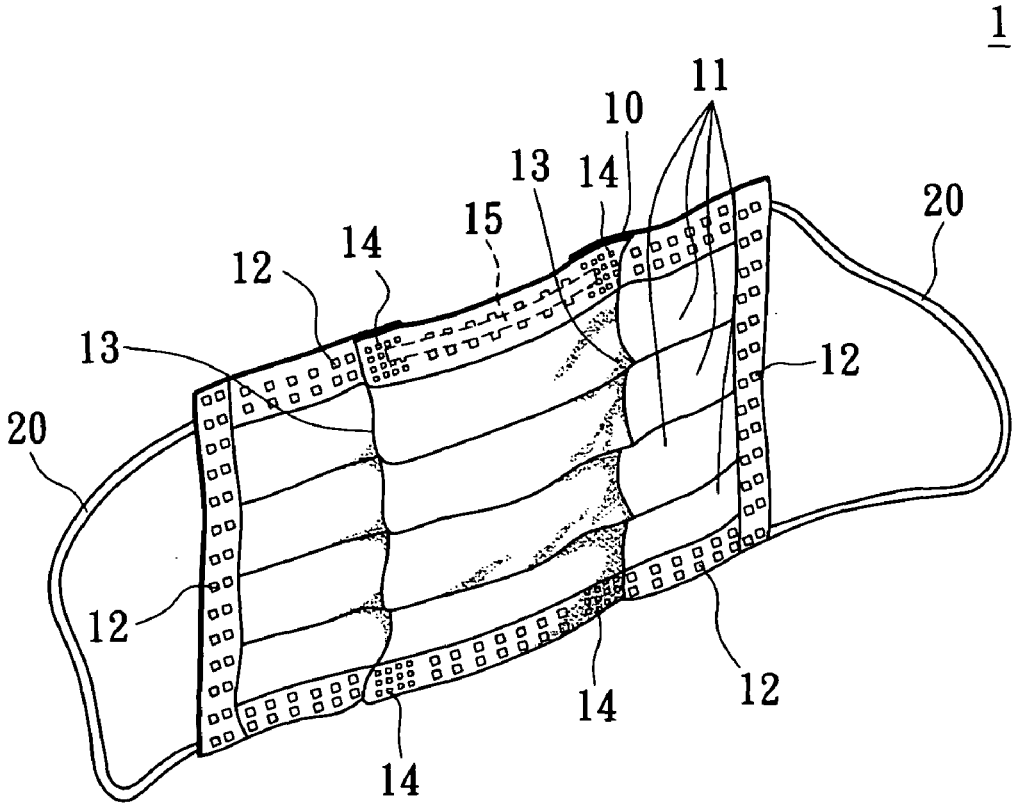
FIG. 2 is a perspective diagram showing a facemask structure in accordance with this invention.
Figure 3:
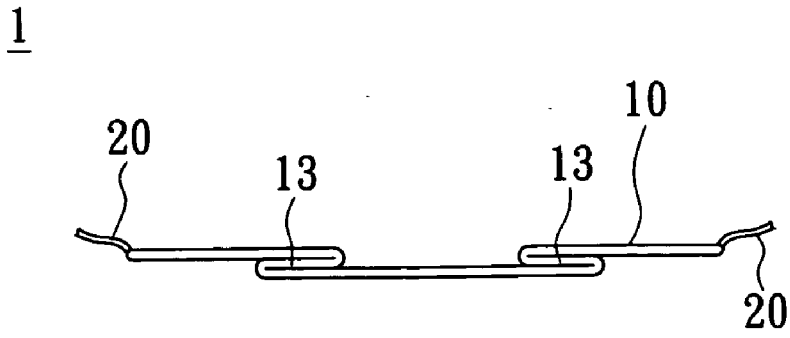
FIG. 3 is a top view of a facemask in accordance with this invention.

Referring to FIGS. 2 and 3, the facemask structure 1 improvement provided by this invention includes a mask body 10 made of a multi-layered filtering material and two ear bands 20. The mask body 10 is rectangular in shape and covers the nose and mouth of the wearer.

The plurality of first folds 11 is placed extending horizontally on the mask body 10. A respective first fixing section 12 is formed by thermal pressing or stitching at the top, bottom, right and left edges of the mask body 10. The first fixing sections 12 at the right and left edges of the mask body 10 fix in place the two ends of the plurality of first folds 11 along with the two ear bands 20, such that the two ear bands 20 are respectively fixed and connected to the right and left sides of the mask body 10, thereby to be looped around the ears of the wearer when used.

Furthermore, a plurality of second folds 13 is placed on the mask body 10. In this embodiment, two of the second folds 13 are shown. The second folds 13 extend vertically on the mask body 10. A plurality of second fixing sections 14 is formed by thermal pressing or stitching at the top and bottom edges 12 of the mask body 10, corresponding to the two ends of the second folds 13. The second fixing sections 14 are used to hold and fix the two ends of the second folds 13.

In addition, a flexible nose adjustment piece 15 can be placed near the upper edge of the mask body 10 in this invention. When the facemask is worn, the flexible nose adjustment piece 15 can be shaped to ensure that the upper edge of the mask body 10 nicely conforms to the contours of the wearer's face, such that no gap can form and the facemask remains airtight. The flexible nose adjustment piece 15 is disposed between the two second folds 13 and has a length which is not exceeding the distance between the two second folds 13. In other words, the length of the flexible nose adjustment piece 15 is limited between the two second folds 13 so that the two second folds 13 can be formed with high efficiency and high precision.

Figure 4:
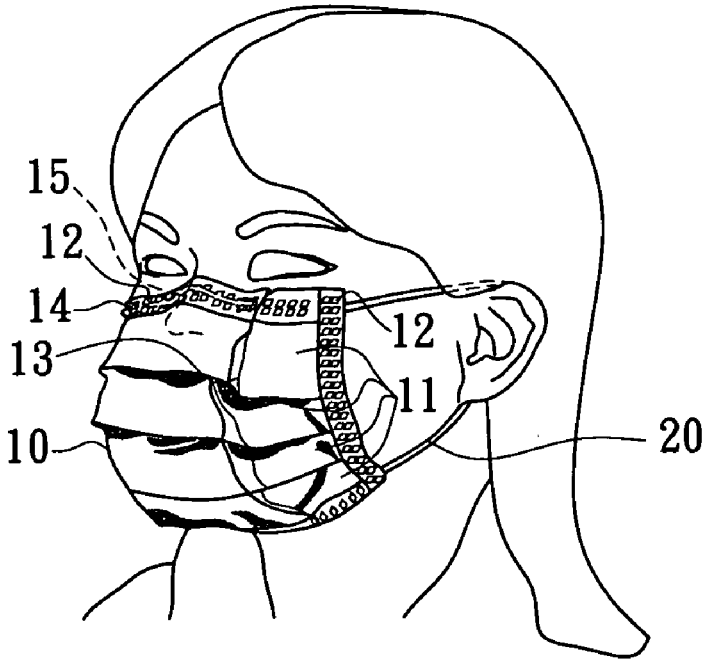
FIG. 4 is a schematic diagram of a facemask being worn, which is in accordance with this invention.

In this invention, by means of the first plurality of folds 11 extending horizontally on the mask body 10, the mask body 10 can be stretched vertically. By means of the second folds 13 extending vertically on the mask body 10, the mask body 10 can be stretched horizontally. Hence, the mask body 10 of this invention is more three-dimensionally shaped than conventional face masks, in a way that it fits better to the contours on the face of the wearer, as shown in FIG. 4, effectively preventing leakages, and giving the wearer greater comfort and convenience.

Moreover, since the facemask of this invention is better three-dimensionally shaped by means of a simple structural design, the cost of producing the facemask is cheaper.

Figure 5:
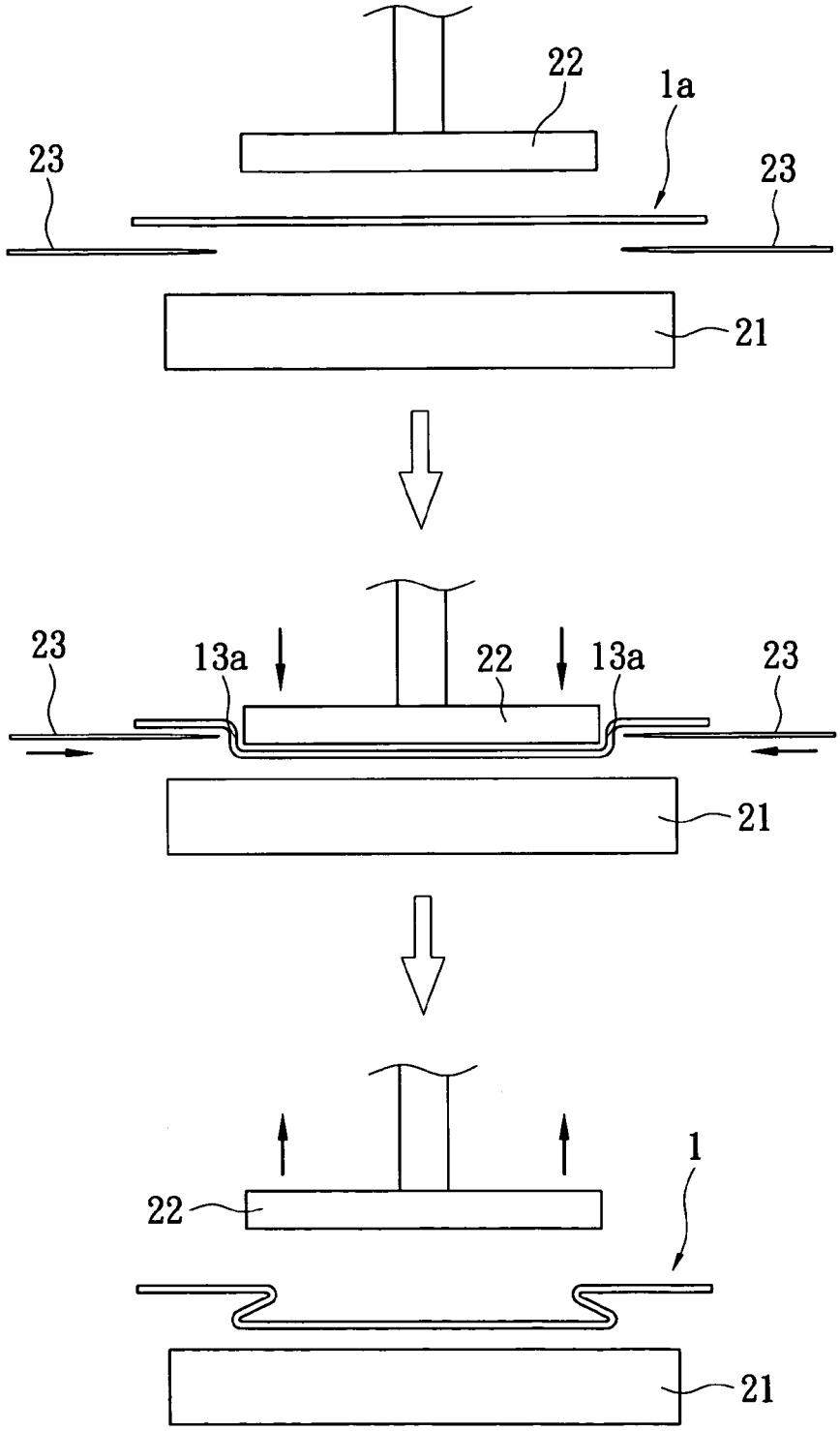
FIG. 5 shows the flow chart for manufacturing the facemask structure.

Please refer to FIG. 5, the method for manufacturing the facemask structure 1 includes the following steps.

Figure 5A:
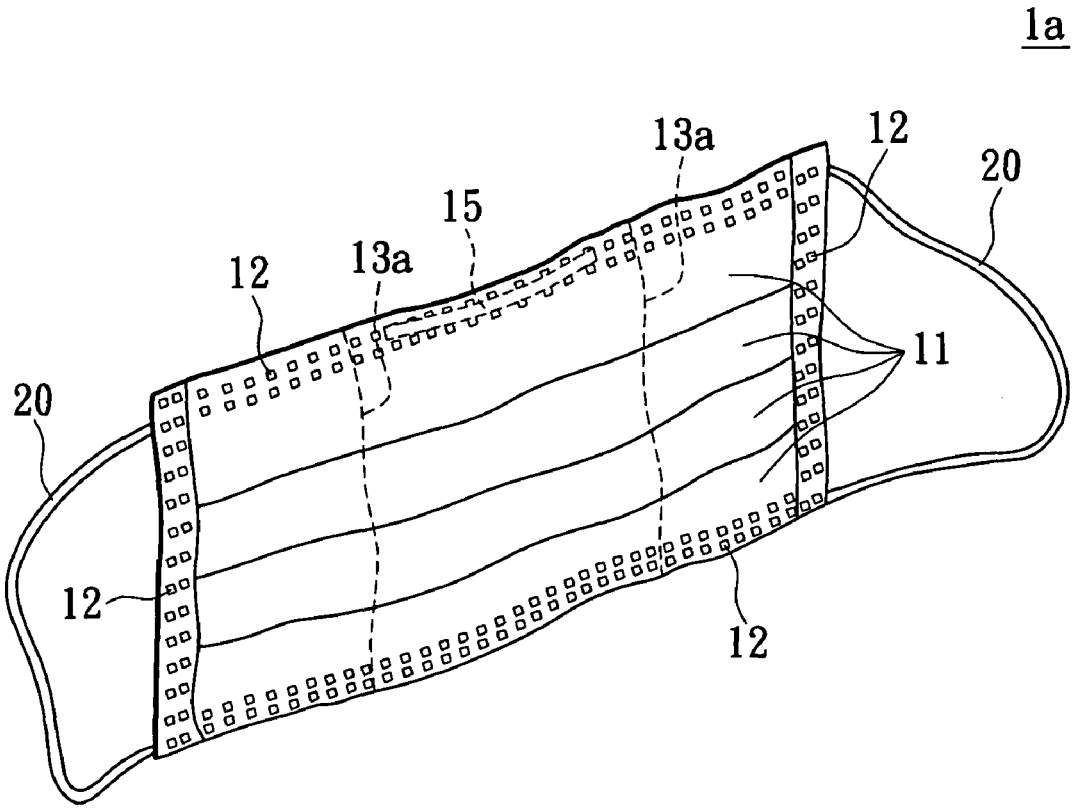
FIG. 5A is a perspective diagram showing a facemask with the first folds.

First step is providing a facemask 1*a* on a seat 21. As shown in FIG. 5A, the structure of the facemask 1*a* is similar to a traditional facemask, for example, facemask has a plurality of first folds extending 11 in a horizontal direction. However, the facemask 1*a* has a length-limited flexible nose adjustment piece 15 near an upper edge 12 of a mask body 10. Two folding positions 13*a* are defined on the mask body 10 of the facemask 1*a* and they are the positions where the second folds 13 are formed. The facemask 1*a* is placed on a tool and the tool has a seat 21, two movable plates 23 and a pressing body 22. When the facemask 1*a* is placed on the seat 21, the sides of the mask body 10 are respectively located on two movable plates 23. The position of each movable plate 23 is higher than that of the seat 21 so that the difference of height is used for generating a step-high on the mask body 10. Moreover, the difference of height can be adjusted depending on the width of the second fold 13. Preferably, the movable plate 23 is a thin plate to fold the mask body 10.

In the present embodiment, the facemask 1*a* is placed on the seat 21 and the two movable plates 23 are placed respectively on the bottom surface of the right and left sides of the mask body 10. The tip of each movable plate 23 is located on the corresponding folding position 13*a* of the mask body 10. Then, the pressing body 22 is used to force on the mask body 10 so that the step-shaped structures are formed on the folding positions 13*a*. In other words, two sides of the pressing body 22 are respectively located on the folding positions 13*a* of the mask body 10. Almost simultaneously, the two movable plates 23 move inwardly to fold the mask body 10 so as to form two second folds 13 extending in a vertical direction on the mask body 10. Because the length of the flexible nose adjustment piece 15 is not exceeding the distance between the two second folds 13 (i.e., the two folding positions 13*a*), the two movable plates 23 can efficiently fold the mask body 10. Preferably, the two ends of the flexible nose adjustment piece 15 are located on the two second folds 13 to provide improved supporting structure. After the two second folds 13 are folded, the second fixing sections 14 is formed on the top and the bottom end of each second fold 13 at the top and bottom edges 12 of the mask body 10 by thermal pressing or supersonic welding method. Accordingly, the facemask structure 1 is formed with the first folds 11 extending horizontally and second folds 13 extending vertically. Furthermore, the flexible nose adjustment piece 15 is disposed between the two second folds 13 for the reasons of the formation in manufacturing.

Therefore, the present invention provides a method for manufacturing the facemask structure 1 which has 3D structure in a using state and is a planar structure in a folded state.

The invention may be embodied in other specific forms without departing from the spirit or essential characteristics thereof. The present embodiments are therefore to be considered in all aspects as illustrative and not restrictive. The scope of this invention is indicated by the appended claims rather than by the foregoing description, and all changes that come within the meaning or the range of equivalency of the claims are therefore intended to be embraced therein.

What is claimed is:

1. A method for manufacturing a facemask structure, comprising steps of:

providing a facemask on a seat, wherein the facemask has a plurality of first folds extending in a horizontal direction, the facemask includes a flexible nose adjustment piece near an upper edge of a mask body of the facemask, the flexible nose adjustment piece is disposed between two folding positions and the flexible nose adjustment piece has a length not exceeding the distance between the two folding positions, and the facemask has the ear bands respectively connected to the right and left edges of the mask body;

providing two movable plates respectively on the bottom surface of the right and left sides of the mask body;

providing a pressing body to force on the mask body, wherein two sides of the pressing body are respectively located on the folding positions of the mask body, the mask body is bended in the two folding positions;

moving the two movable plates inwardly to fold the mask body so as to form two second folds extending in a vertical direction; and fixing second fixing sections on a top and a bottom edges of the mask body.

2. The method according to claim 1, wherein the two movable plates are higher than the seat in the step of providing two movable plates.

3. The method according to claim 1, wherein the flexible nose adjustment piece is disposed between two second folds after the step of moving the two movable plates inwardly.

4. The method according to claim 1, wherein a tip of each movable plate is located on the corresponding folding position of the mask body in the step of providing two movable plates.

* * * * *